US005772405A

United States Patent [19]

Eller

[11] Patent Number: 5,772,405

[45] **Date of Patent: *Jun. 30, 1998**

[54] WATER SYSTEM WITH A PEDAL POWERED RECIPROCATING PUMP

[75] Inventor: James David Eller, Deerfield Beach, Fla.

[73] Assignee: MWI Corporation, Deerfield Beach, Fla.

[ * ] Notice: The terminal 17 months of this patent has been disclaimed.

[21] Appl. No.: 415,483

[22] Filed: Apr. 3, 1995

[51] Int. Cl.[6] ..... F04B 17/06

[52] U.S. Cl. ..... 417/233; 417/552; 417/411; 74/44

[58] Field of Search ..... 417/229, 230, 417/231, 233, 411, 545, 552, 555.1, 555.2; 74/44, 591, 603

[56] References Cited

U.S. PATENT DOCUMENTS

| | | | |
|---|---|---|---|
| 194,377 | 8/1877 | Schenck | 92/76 |
| 344,133 | 6/1886 | Phillipe | 417/536 |
| 350,805 | 10/1886 | Chew | 417/552 |
| 559,418 | 5/1896 | Spencer | 417/233 |
| 705,425 | 7/1902 | Musser | 74/105 |
| 1,101,410 | 6/1914 | Cooper | 417/545 |
| 1,358,213 | 12/1920 | Joerns | 74/41 |
| 1,455,601 | 5/1923 | Lox | 417/233 |
| 1,592,021 | 7/1926 | De Lew et al. | 74/432 |
| 1,664,524 | 4/1928 | Milz | 74/591 |
| 1,756,089 | 4/1930 | Hunter | 74/37 |
| 3,547,083 | 12/1970 | Peterson | 417/545 |
| 3,684,410 | 8/1972 | Fitzgerald et al. | 417/354 |
| 3,861,223 | 1/1975 | Braun | 74/44 |
| 4,008,008 | 2/1977 | Vergnet | 417/685 |
| 4,303,833 | 12/1981 | Eckel et al. | 417/244 |
| 4,507,060 | 3/1985 | Sutz | 417/336 |
| 4,565,502 | 1/1986 | Sell | 74/591 |
| 4,802,829 | 2/1989 | Miller | 417/411 |
| 4,834,620 | 5/1989 | Sweeney | 417/53 |
| 4,866,430 | 9/1989 | Veronesi et al. | 417/423.13 |
| 5,016,870 | 5/1991 | Bulloch et al. | 272/73 |
| 5,105,671 | 4/1992 | Slater | 417/411 |
| 5,336,061 | 8/1994 | Armstrong | 417/411 |

OTHER PUBLICATIONS

S. Arlosoroff, et al, Community Water Supply, The Handpump Option, The World Bank, Washington, D.C. 1987, pp. 1x, 49–51, 59, 106–107, and 142–143.

S. Arlosoroff et al, Handpumb Testing and Development—Report No. 4, The World Bank, Washington, D.C., pp. 155, 257, 265–267.

M. Daumas, A History of Technology & Invention, vol. II, Crown Publishers, New York, 1969 p. 21.

*Primary Examiner*—Richard A. Bertsch
*Assistant Examiner*—Peter G. Korytnyk
*Attorney, Agent, or Firm*—Oltman, Flynn & Kubler

[57] ABSTRACT

A water system includes a reciprocating pump operated by pedal power. The pumpstand includes a housing in which a foot pedal and a drive shaft rotate. An eccentric pin, rotating with the drive shaft, moves a connecting rod, which in turn causes a pushrod to oscillate vertically. The pushrod extends into a pressure-tight chamber formed above the rising main (wellpipe). A pumprod connected to the pushrod extends to move a conventional plunger through vertical oscillations. A flywheel is attached to the drive shaft, and a counterweight is mounted on the flywheel diametrically opposite the eccentric pin. The radial distance from the drive shaft to the counterweight can be adjusted. A discharge pipe extends from the pressure-tight chamber to an elevated or pressurized storage tank. A distribution pipe from the storage tank feeds water to a number of distribution points, such as faucets in houses.

20 Claims, 4 Drawing Sheets

WATER SYSTEM WITH A PEDAL POWERED RECIPROCATING PUMP

BACKGROUND OF THE INVENTION

Field of the Invention

This invention relates to water distribution systems, and more particularly, to water distribution systems powered by human power.

Background Information

The history of positive displacement reciprocating pumps goes back as far as 275 BC in Ancient Rome. In the sixteenth century, great lift and force pumps, driven by water wheels became the principle method for pumping water to be piped in Europe.

As late as 1987, the World Bank estimated that, throughout the world, 1.8 billion people would need improved water supplies, and that wells equipped with handpumps would be an appropriate choice to meet the needs of this number of people. Most of the reciprocating handpumps commonly used in developing countries have their origins in designs developed during the late 19th and early 20th Centuries in the United States and in Europe. In the United States, about 42 million handpumps were made until 1920, when electric pumps began to replace them. While the basic design of the reciprocating handpump has not changed much in this century, its typical use has changed greatly. In the early part of this century, in the United States and Europe, the big market for pumps was for small backyard pumps used for ten to thirty minutes per day by individual families or farmers. In a developing country today, a single pump may have to supply more than 500 villagers and may be in continuous operation for ten or more hours per day.

What is needed in a developing country is a manually operated pump which can be easily operated by a person for relatively long periods of time and which lifts significant volumes of water with as little effort as possible. Because of the high usage requirements, and because the pump must operate as a practical device far from cities having maintenance facilities and personnel, the pump must be both reliable and easily repaired.

A handpump connected with a typical well is driven by pressing the end of a lever downward and by either pulling it upward, or permitting it to return upward due to the weight of the well. The work of lifting the water occurs as the lever is pressed downward. The simplest type of reciprocating pump is the suction pump, which draws water from shallow wells by creating a partial vacuum in a suction pipe. All of the moving parts, including a plunger moved by the lever and a suction check valve, are located above ground; only the suction pipe extends downward into the well. As the lever is pushed downward, the plunger is moved upward, lifting the water above it to be discharged through a spout, and pulling water below it upward through an open suction check valve. As the lever is moved upward, the plunger is moved downward, through the water below it, creating a pressure which opens a valve in the plunger while closing the suction check valve. Two disadvantages of this type of pump are first, it must be primed with water before it can be used and, second, the suction principle, depending on atmospheric pressure to lift water, limits the usefulness of the device to wells having depths less than about seven meters.

In deepwell reciprocating pumps, the cylinder is immersed within the well below the water level, being pulled up and down by a rod extending down the well pipe.

This arrangement is suitable for wells as deep as 45 meters or more, with the operating limit depending on the effort that users are willing to apply for progressively less water at increased depths. As the depth of the well is increased, more work is required to lift the column of water in the well pipe, together with the steel rod extending down the well pipe to the cylinder.

One problem with most reciprocating pumps is caused by the fact that the lever used to operate the pump, while providing an exceedingly simple mechanism, does not make particularly good use of the ability of the human body to do mechanical work. The downward force that a person can provide to lift water in this way is limited by his own weight, and the lever primarily uses the muscles moving the arms and upper body, while, in a typical person, the muscles moving the leg are much stronger and more capable of use for extended times.

Another problem with most reciprocating pumps arises from the fact that the work of lifting the water and the pump mechanism occurs only as the lever is pushed down. For example, a conventional reciprocating pump requires a force of about 20 kg as the lever is pushed down, while a force of only about 4 kg is required to move the lever back upward. Thus, uneven demands are placed on the user to supply energy to the pumping process.

A number of pump configurations have been built to overcome various of these disadvantages in the way driving forces are applied. For example, a treadle type foot pedal drive, together with a pair of flywheels, has been applied to a double piston pump, Model SB-115, produced by the Water Conservancy Bureau of Shandong Province, China. The Climax handpump, manufactured by Wildon Engineering of Worcestor, United Kingdom, and the Volanta handpump, manufactured by Jensen Venneboer BV, The Netherlands, are both pumps in which a reciprocating motion is developed using a connecting rod driven by a rotating crank mounted on a shaft along with a flywheel. An eccentric rod extends from the flywheel for use as a hand crank. The Climax handpump also uses a counterweight to balance the lifting force applied through the crank.

Thus, the pump from Shandong Province, China, has the advantage of using the stronger muscles moving the legs, while the flywheels of all three of these types of pumps help to spread the force requirements over the operating cycles through the storage of energy. The counterweight of the Climax handpump provides additional help in evening the torque requirements of the hand crank.

Nevertheless, the posture and leg movements of bicycle riding, which are known to be both comfortable and practical for providing mechanical work over an extended period, are not used for power input in these pumps. A bicycle type seating and pedaling arrangement is used to drive centrifugal pumps, Model 1-1/2-JB, produced by the Anyue County Farm Machinery Plant, Sichuan Province, China, and Model Jinshan-402B, produced by the Zhenjiang Sprinkler Plant, Jiangsu Province, China.

What is needed is a pump incorporating the posture and pedal configuration of a bicycle for power input with the simplicity, reliability, and flexibility of application of the reciprocating pump.

The force required to lift the water and rod mechanism of a reciprocating pump varies with the depth of the well. While the counterweight of the Climax pump attempts to balance this force, it cannot be moved to compensate for differences in well depth from one installation to another. Even within one installation, it is not unusual to increase the depth of a well to compensate for a falling water table. Therefore, what is needed is a way to vary the position of the counterweight to compensate for differences in force resulting primarily from differences in well depth.

The virtues of flywheels and of counterweighting are also discussed by S. Arlosoroff, et al., Community Water Supply, The Handpump Option, (The World Bank, Washington, D.C., 1987) indicating that a properly counterbalanced flywheel in a pumping application can build tip considerable speed, particularly when it is operated by two people. These editors further point out that counterweights should at least balance the pull of the pumprod and the plunger.

A conventional handpump or other reciprocating pump includes a spout extending outward and slightly downward from a point a few feet above the ground, below the point at which the pump is operated. Thus, at the spout, a rod extends upward through an opening, being attached to a lever or, in the case of the Climax and Volanta pumps, to a drive crank by means of a connecting rod. Since the top of the pump is not sealed, water cannot be raised above the spout by the pump. On the other hand, the electrically powered water pumping systems in developed countries are typically sealed in such a way that a substantial pressure can be developed above the pump. In a typical water system, this pressure is used either to raise the level of the water to an elevated storage Level or to inject the water into a pressure tight tank at ground level. Water stored in this way is subsequently dispensed under pressure through a piping system, which may serve an individual rural house or an entire city.

In developing countries, this kind of water distribution is desirable too, although it is not generally achieved in rural areas. A piped system, supplying water for individual houses, provides significant advantages, both in terms of convenience and sanitation. Considering the changes described above in the patterns of usage of manually operated pumps, by which one pump may have to supply water for 500 villagers, what is particularly needed is a water supply system including a reciprocating pump which can be operated by means of a hand crank or pedal system and which can pump water under pressure into an elevated or pressurized tank.

Description of the Prior Art

U.S. Pat. No. 1,358,213 to Joerns describes a gear driven reciprocating pump having an upper seal, through which a pair of reciprocating rods operate, and a pressure chamber formed with a division wall and an outlet passageway, allowing the discharge of water near the top of the standard. This feature allows the pump to be operated under considerable pressure for various purposes, discharging a steady stream of water under the pressure of the pump.

While the pump of Joerns shows improvements in the mechanism used to produce reciprocating motion, the gear mechanism is still driven by a handle, or by an unspecified external source of power operating a pulley. What is needed, for the effective application of the Joerns device to the rural areas of a present day developing country, are the other components of a complete water system for supplying water to a number of faucets, together with means allowing the device to be operated by the more efficient process of pedaling.

U.S. Pat. No. 1,592,021 to De Lew et al and U.S. Pat. No. 4,886,430 to Veronesi et al. describe different types of pumping applications in which a flywheel is used. De Lew describes a detachable flywheel for use in a reciprocating oil well pump driven by an electric motor through a walking beam, while Veronesi describes the use of a flywheel, along with an electric motor and a centrifugal pump impeller, within a hermetically sealed casing, through which the fluid being pumped flows. U.S. Pat. No. 5,016,870 to Bulloch et al describes an exercise device having EL bicycle type pedal arrangement used to supply mechanical power to a flywheel, with an adjustable brake creating a variable resistance to the pedaling process.

SUMMARY OF THE INVENTION

In accordance with one aspect of the invention, there is provided a pumpstand for driving a pumprod in a vertically reciprocating motion. The pumpstand includes a housing, a drive shaft, a transmission mechanism, a counterweight, a foot pedal, and a chain. The drive shaft is mounted to rotate within the housing, with a driven sprocket and a flywheel attached to the drive shaft. The transmission mechanism converts motion of the drive shaft into vertically reciprocating motion of the pumprod. The counterweight is raised as the pumprod is lowered and lowered as the pumprod is raised. The foot pedal is also mounted to rotate within the housing, with a driving sprocket attached to the foot pedal. The chain extends between the driving sprocket, engaging these sprockets so that rotation of the driving sprocket causes rotation of the driven sprocket.

In accordance with another aspect of the invention, there is provided a water supply system for delivering underground water to a number of distribution points. The system includes a rising main (pipe extending down a well), a vertically oscillating structure, a foot valve, a pressure tight chamber, a pumpstand housing, a transmission mechanism, a sealing mechanism, a discharge pipe, a distribution pipe, and a pressurizing mechanism. The rising main extends downward into the underground water. The vertically oscillating structure includes a pumprod sliding in the rising main and a plunger sliding in the rising main and in the underground water. The plunger includes a plunger valve opening as the plunger is moved downward through the underground water and closing as the plunger is moved upward through the underground water. The foot valve controls a flow of water from a lower portion of the rising main below the plunger, opening as water flows into this lower portion and closing to prevent a flow of water from this lower portion. The pressure tight chamber is at the top of the rising main. The pumpstand housing extends upward from the pressure tight chamber. A drive shaft, on which a flywheel and counterweight are mounted, is mounted to rotate on the pumpstand housing. A chain drive extends between the foot pedal and the drive shaft causing rotation of the drive shaft as the foot pedal is rotated. The transmission mechanism converts rotation of the drive shaft into vertical oscillation of the vertically oscillating structure. The sealing mechanism prevents loss of water around a part of the vertically oscillating structure extending through the pressure tight chamber. The discharge pipe extends from the pressure tight chamber to a storage tank, the distribution pipe extends from the storage tank to distribution points. The pressurizing mechanism causes a flow of water through the distribution pipe to the distribution points.

BRIEF DESCRIPTION OF THE DRAWINGS

Preferred embodiments of the subject invention are hereafter described with specific reference being made to the following Figures, in which.

DETAILED DESCRIPTION

Figure 1:
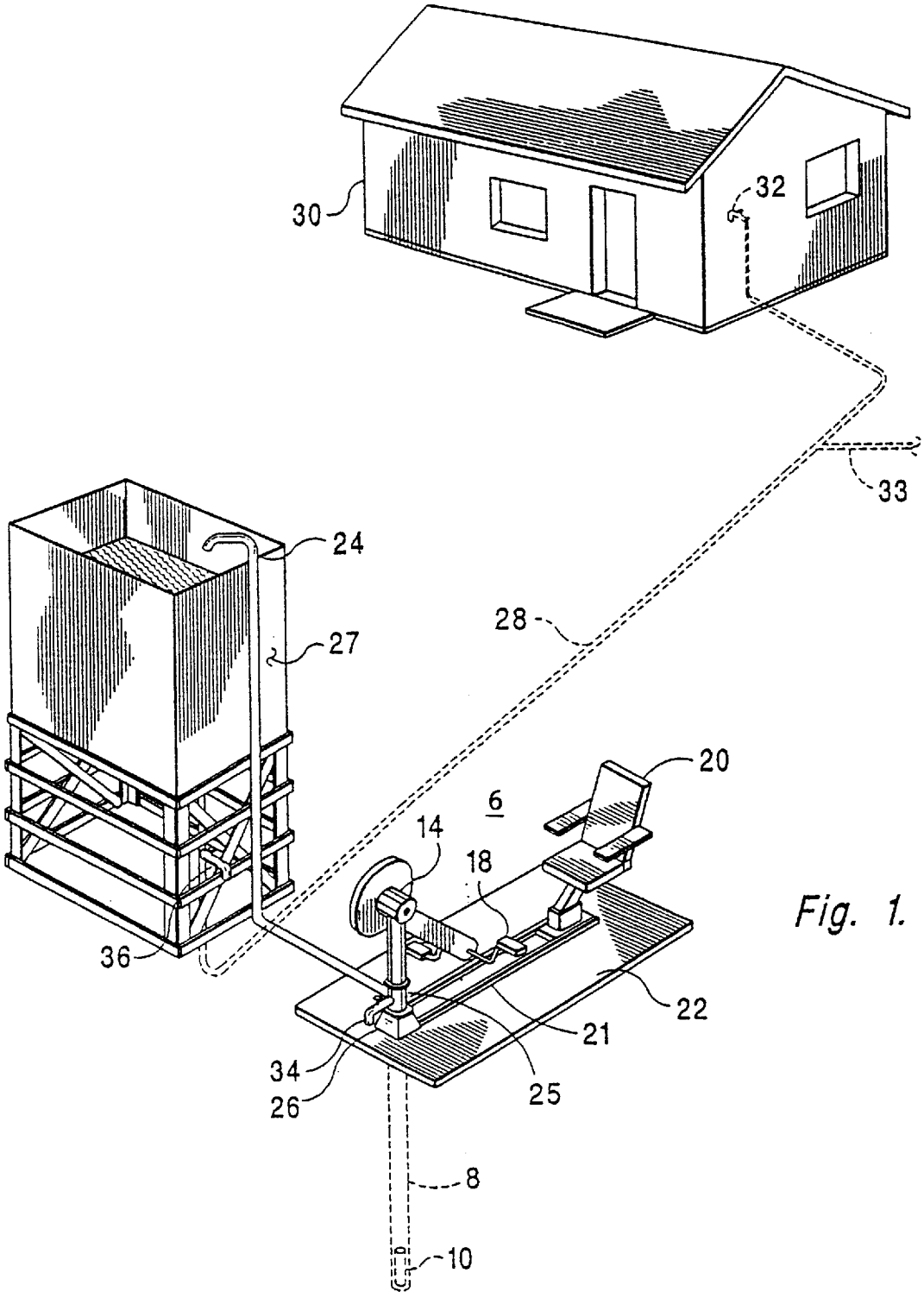
FIG. 1 is a perspective view of various portions of a rural community water supply system built in accordance with the present invention.

FIG. 1 is as perspective view of various portions of a rural community water supply system built in accordance with the present invention. A pumping station 6 includes a rising main 8 (wellpipe) descends below the ground to a level at which a cylinder 10, within the rising main 8, is immersed in ground water. Generally, and as explained in more detail in FIG. 2, within cylinder 10, a plunger is raised and lowered in a reciprocating motion by means of a pumprod, which, in turn, is moved by means of a mechanism within a pumpstand 14. The energy required to operate the mechanism within pumpstand 14 is obtained as a person pedals a foot pedal 18, while sitting in a seat 20 in a posture similar to that of a bicycle rider. Seat 20 is attached to pumpstand 14 by means of frame rails 21. Both pumpstand 14 and seat 20 may be mounted on an optional concrete foundation pad 22.

A discharge pipe 24, connected into a pressure tight chamber 25 near a base 26 of pumpstand 14, extends upward to a point up to eight meters above the ground surface to fill an elevated water tank 27,. A distribution pipe 28 extends downward from the bottom of water tank 27 and outward to provide water to a number of buildings 30 with faucets 32 and other water attachments (not shown). Distribution pipe 28 may be part of a network including other distribution pipes 33. A first bibcock 34, at pumpstand 14, and a second bibcock 36, at distribution pipe 28, are also provided, to be used for the attachment of a hose (not shown) or for filling water vessels (also not shown). If water is quickly needed when tank 27 is empty, it may be obtained from first bibcock 34 as the pumpstand 14 is operated with footpedals 18. Alternately, if tank 27 is not empty, water may be obtained from second bibcock 36, as well as from faucets 32.

Figure 2:
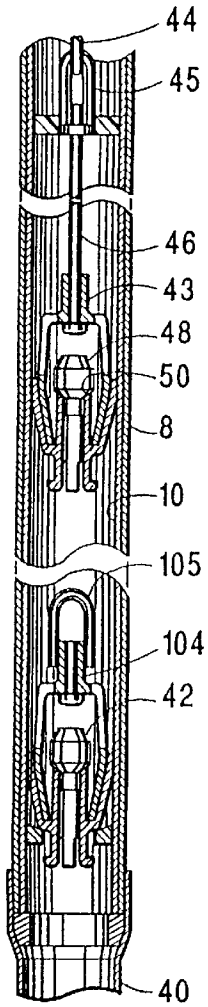
FIG. 2 is a vertical cross-sectional view of an underground cylinder portion of the system of FIG. 1.

FIG. 2 is a vertical cross section of the mechanism of cylinder 10, which is conventional in design, at the bottom of rising main 8. Water enters cylinder 10 through a suction pipe 40, preferably rising to a groundwater level at or somewhat above the top of cylinder 10. A foot valve 42, operates as a check valve, opening with the flow of water into cylinder 10, while being otherwise closed. Within cylinder 10, plunger 43 is moved upward and downward in a reciprocating motion by pumprod 44, which is hooked onto an eyehook portion 45 of plunger fitting 46. As plunger 43 moves downward, plunger valve 48 opens to allow a flow of water through plunger 44 along a valve seat 50. In this way, plunger 43 moves downward easily, as foot valve 42 is closed to prevent the outward flow of water. As plunger 43 is moved upward, plunger valve 48, also operating as a check valve, closes, so that the water above the plunger 43 is lifted. The resulting suction causes foot valve 42 to open, allowing more water to flow into cylinder 10.

Figure 3:
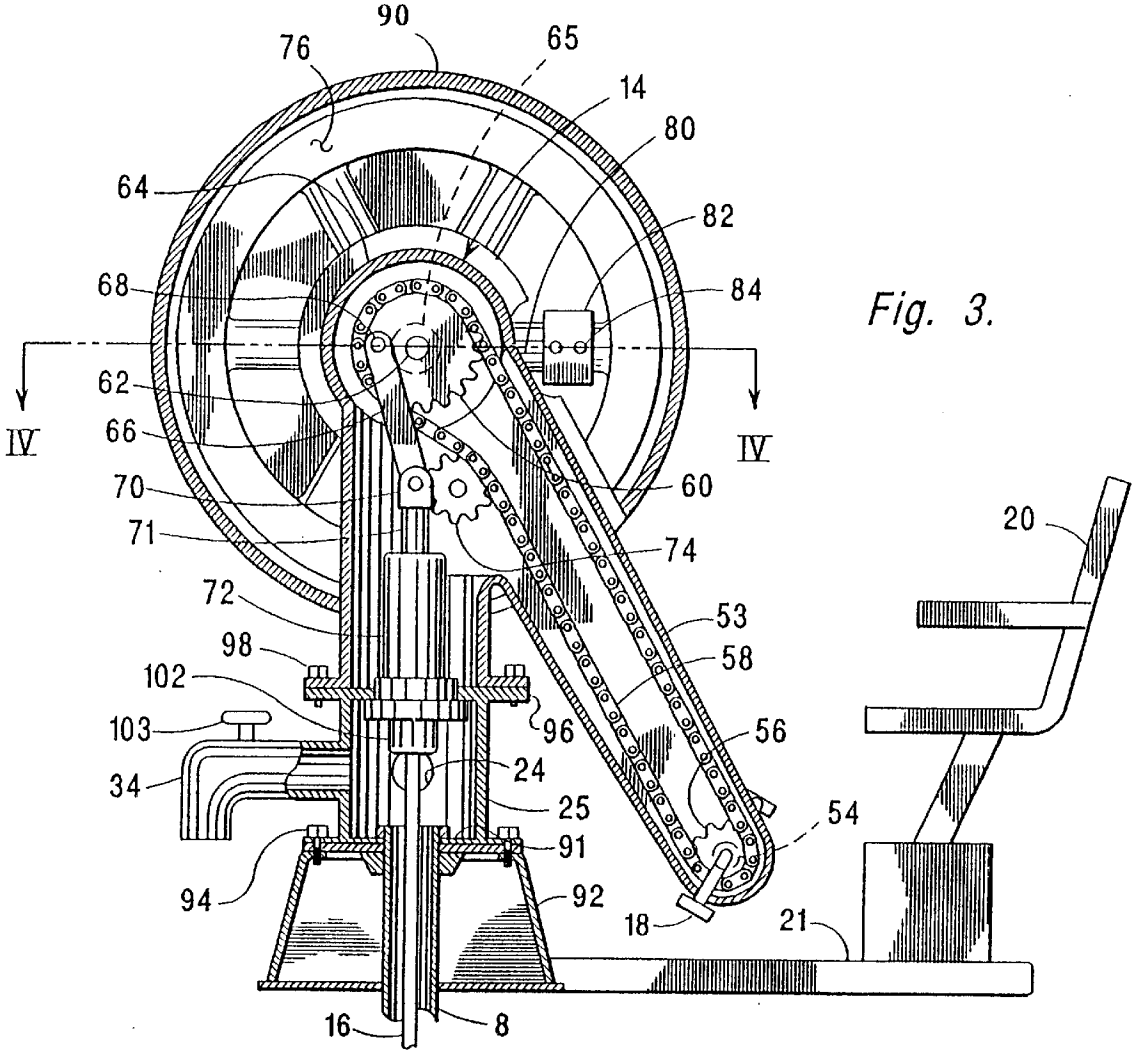
FIG. 3 is a vertical cross-sectional view of a pumpstand of the system of FIG. 1.
Figure 4:
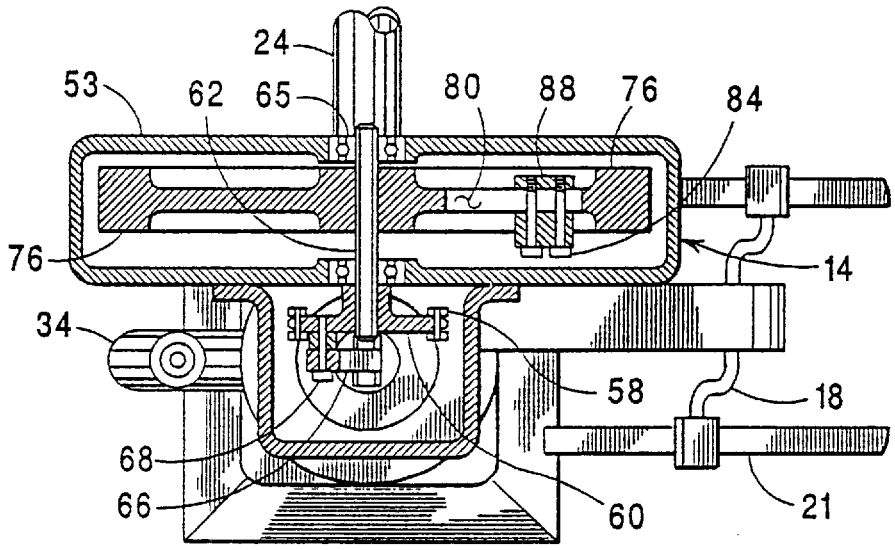
FIG. 4 is a horizontal cross-sectional view of a portion of the pumpstand of FIG. 3, taken as indicated by section lines IV-IV in FIG. 3.

Referring now to FIGS. 3 and 4, which show views of the mechanisms of pumpstand 14, positioned at the top of rising main 8. More specifically, FIG. 3 shows a vertical cross-sectional view and FIG. 4 shows a horizontal cross-sectional view taken through section lines IV-IV in FIG. 3. In FIG. 3, various shields or housing sections 53, which are provided particularly to prevent personal injury by moving parts, are shown in cross-section to reveal the mechanisms installed therein.

As foot pedal 18, rotatably mounted in a pair of bearings 54, is operated, a drive sprocket 56, mounted to turn with foot pedal 18, drives a chain 58, which in turn causes the rotation of a driven sprocket 60. Sprocket 60 is mounted firmly on a drive shaft 62, which is rotatably mounted within a housing 64 by means of a pair of bearings 65. A connecting rod 66 is pivotally mounted to extend between an eccentric pin 68 extending from driven sprocket 60 and a fitting 70 at the top of a pushrod 71 connected to pumprod 44. Pushrod 71 is mounted to slide vertically within a bearing structure 72. An idler sprocket 74, which is also rotatably mounted within housing 64, may be adjusted in position to maintain a suitable tension on chain 58.

A flywheel 76 is also attached to turn with shaft 62, with a spoke 78, having a radial slot 80, extending diametrically opposite eccentric pin 62. A counterweight 82 is clamped in place on flywheel 76 by means of a pair of screws 84 extending through slot 80 to engage a clamping plate 88. A flywheel housing 90 may be included to protect others from the rotating flywheel 76. With this; arrangement, the counterweight 82 is moved to its lowest position as pumprod 44 is moved to its highest position, and vice versa. In this way, counterweight 82 is used to counterbalance the combined weight of pumprod 44, of plunger 43 (shown in FIG. 2) and of the water within rising main 8 and within the rising portion of discharge pipe 24.

Using screws 84, the position of counterweight 82 may be adjusted along the length of slot 80. Since the combined weight to be counterbalanced varies greatly with the depth of the well and the height of discharge pipe 24, this adjustment is used to customize pumpstand 14 as it is installed on an individual well. After the initial installation process, the position of counter-weight 82 may be changed to accommodate changes to the system, such as variations in the height of the discharge pipe 24, changes in the depth of well, or even preferences of the user. In providing an adjustment, pumpstand 14 provides a significant advantage over the Climax handpump, described above, which has a counterbalance mounted in a fixed position.

During operation of the water supply system, water is brought upward through rising main 8 into pressure tight chamber 25 between a lower flange plate 91, fastened atop base 92 with a number of screws 94, and an upper flange plate 96, to which pumpstand housing 64 is in turn fastened with screws 98. First bibcock 34 and discharge pipe 24 extend from the pressure tight chamber 25. Pressure is maintained within chamber 25 through the use of a sliding seal 102, which prevents the leakage of water into bearing structure 72. The conventional valve mechanism within bibcock 34, operated by a handle 103, forms another part of the system sealing chamber 25 whenever this bibcock 34 is closed.

In this way, pumpstand 14 is provided with a significant advantage over conventional pumpstands producing reciprocating motion, in that conventional pumpstands do not include a plate extending across the top of the well in this way, or any method for sealing around a rod descending into the rising main. Therefore, a conventional pumpstand can only provide water through a spout extending at the low level of first bibcock 34.

On the other hand, the pumpstand 14 can pump water under pressure into elevate d tank 27, forming part of a water supply system providing water to individual houses or other remote locations. The use of a storage tank in this way also allows the drawing of water for use to occur at a different time than the pumping of the water.

Referring to FIGS. 2 and 3, while a pressure tight chamber 25 is provided, the entire pumpstand 14 may be removed by loosening screws 98, and the pressure tight chamber 25 may be removed from the well by loosening screws 94. Discharge pipe 24 is preferably connected to chamber 25 by conventional, removable means to facilitate this process. In this way, access is provided to allow plunger 43 to be lifted out of the well, for maintenance, by means of pumprod 44. Footvalve structure 104 is fitted with a loop 105, so that it may also be lifted out of the well in this way.

Figure 5:
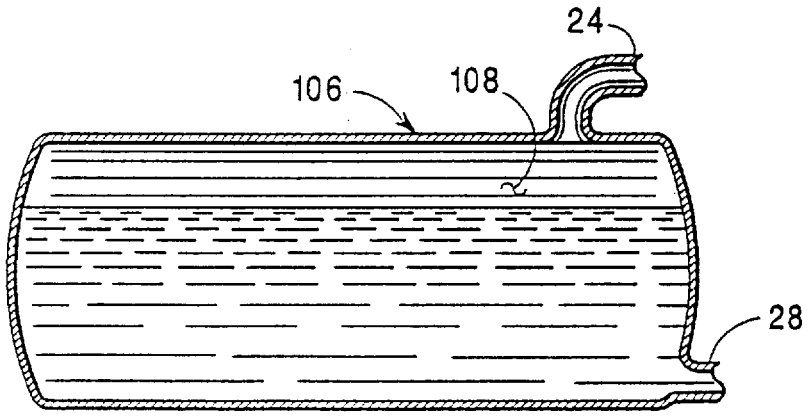
FIG. 5 is a. vertical cross-sectional view of a pressure tight water storage tank which may be used as an alternative to the elevated tank of FIG. 1.

Referring now to FIG. 5, a cross-sectional view of a pressure tight water tank 106 is shown. Tank 106 may be used in place of the elevated water tank 27, shown in FIG. 1. As water is pumped into pressure tight tank 106 from discharge pipe 24, the air held in tank section 108 above the water level is compressed, providing pressure to force water through distribution pipe 28 extending from the tank 106 as faucets 32 or other valves along distribution pipe 28 are opened. The use of air pressure in this way makes it unnecessary to place tank 106 on an elevated structure.

Figure 6:
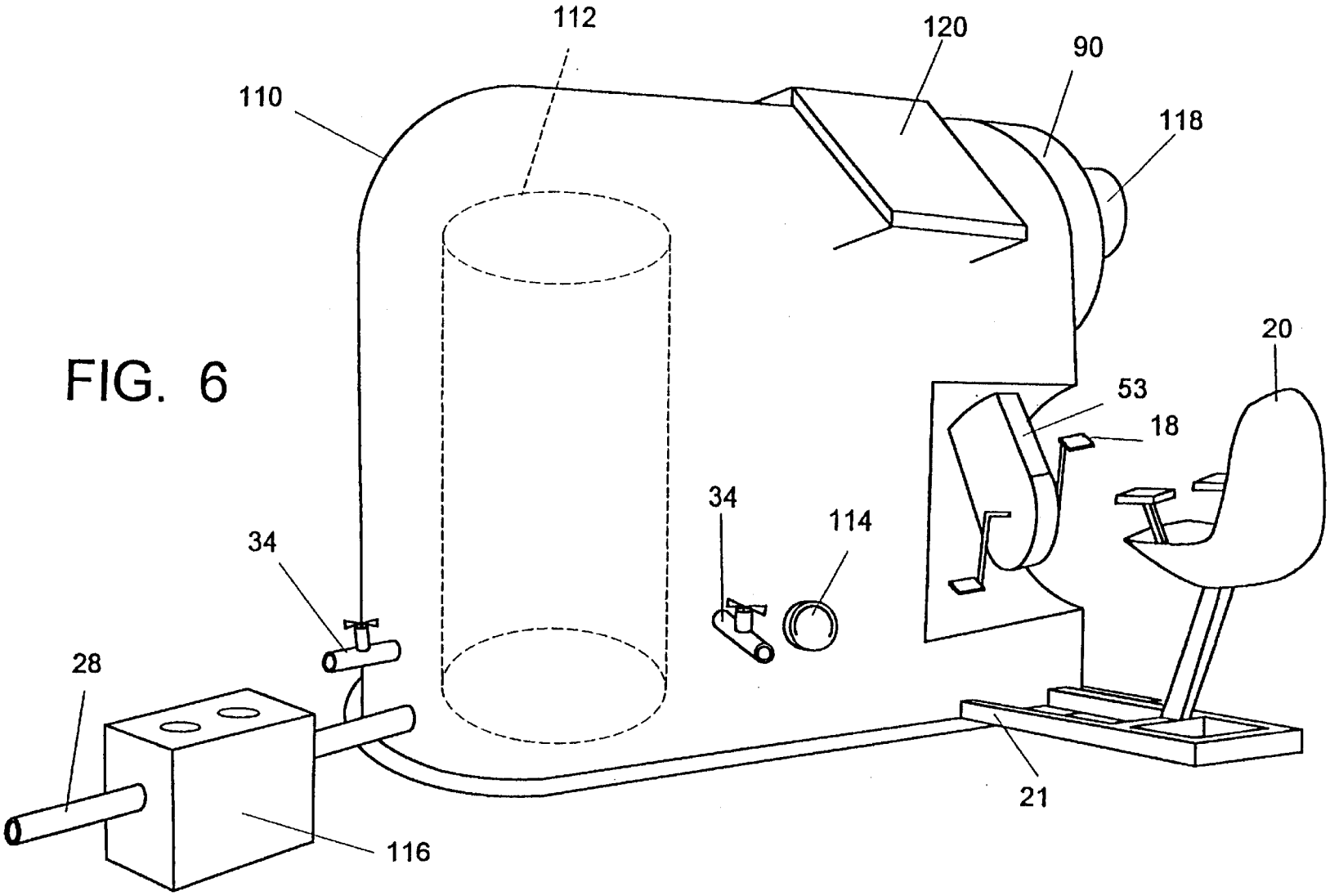
FIG. 6 illustrates the pumping station and water storage unit in a common housing, adapted for easy setup at a remote village.

Referring now to FIG. 6, a housing 110 for containing pumping station 6 and a water storage unit is shown. Where previously described elements are shown in FIG. 6, like reference numerals are used. A precharged water tank 112 is included within housing 110 and may be similar pressure tight tank 106 shown in FIG. 5, or tank 112 may preferably be a precharged water tank of a type commercially available from, for example, Dayton Electric Mfg Co., of Chicago, Illinois. Precharged water tanks typically consist of an elastic bladder, such as butyl rubber bladder, contained in a metal housing. The bladder expands as water is added through discharge pipe 24 and presents a pressure force on the water due to the elasticity thereof. As water leaves the bladder through distribution pipe 28g, the bladder contracts while maintaining the water under pressure until the bladder is nearly empty. Internal piping within housing 110 (not shown) connects the pumping station 6 mechanisms, shown in FIGS. 2–4, to tank 112 in a conventional manner. This piping may include a debris trap or filter (not shown) for preventing sand or small stones from entering precharged tank 112. Similarly, internal piping connects the output from precharged tank 112 to a plurality of bibcock 34 located on housing 110, as well as to distribution pipe 28. In addition, a pressure gauge 114 may be added to provide the operators with information of the available pressure of the water leaving precharged tank 112.

A water treatment system 116 may be added between the output from precharged tank 112 and distribution pipe 28 for adding chemicals appropriate for a community water system. Alternatively, water treatment system 116 may be placed within housing 110 between the pumping station 6 and precharged tank 112 along with the debris trap.

Because of the inclusion of flywheel 76, the effort needed to maintain the continued operation of the pumping station 6 is not great, particularly when precharged tank 112 is not full. In fact a small electric motor 118 may be affixed to flywheel housing 90 to provide a rotational force to flywheel 76. Motor 118 may be powered by a small solar panel 120 located on the top of housing 110, since conventional electric power is not generally available in the areas where this invention will be used. It should be noted that motor 118 only maintains the rotation of flywheel 76. Manual use of foot pedals 18 will still be required to start the pumping action of pumping station 6.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A pumpstand for driving a pumprod in a vertically reciprocating motion, said pumpstand comprising:

a housing;

a drive shaft rotatably mounted within said housing, with a driven sprocket and a flywheel attached to said drive shaft;

transmission means for converting rotary motion of said drive shaft into said vertically reciprocating motion of said pumprod;

a counterweight turning with said drive shaft, wherein said counterweight is raised as said pumprod is lowered, and wherein said counterweight is lowered as said pumprod is raised;

a foot pedal rotatably mounted within said housing, with a driving sprocket attached to said foot pedal; and a chain extending between said driving sprocket said driven sprocket, said chain engaging said sprockets so that rotation of said driving sprocket causes rotation of said driven sprocket.

2. The pumpstand of claim 1, wherein said counterweight is attached to said drive shaft in a manner allowing adjustment of a radial distance between said drive shaft and said counterweight.

3. The pumpstand of claim 2, wherein said flywheel includes a radially extending structure along which said counterweight is attached.

4. The pumpstand of claim 3, wherein said radially extending structure is an aperture slot through which said counterweight is fastened to said flywheel.

5. The pumpstand of claim 1, wherein said transmission means comprises:

an eccentric pin turning with said drive shaft;

a pushrod extending downward from said pumpstand, said pushrod being mounted to slide vertically; and a connecting rod extending between said eccentric pin and said pushrod, said connecting rod being rotatably mounted on said eccentric pin and pivotally mounted on said pushrod.

6. The pumpstand of claim 5, comprising in addition:

a plate with an aperture through which said pushrod extends within a pressure seal, said plate separating a chamber from a portion of said transmission means; and means for connecting a discharge pipe to said chamber.

7. The pumpstand of claim 1, comprising in addition a plate separating a chamber from a portion of said transmission means;

means for connecting a discharge pipe to said chamber; and pressure sealed means for transmitting reciprocating motion through said plate.

8. The pumpstand of claim 1, comprising in addition a seat for sitting upon to operate said foot pedal.

9. A water supply system for delivering underground water to a plurality of distribution points, wherein said system comprises:

a rising main extending downward into said underground water;

a vertically oscillating structure including a pumprod sliding in said rising main and a plunger sliding in said rising main and within said underground water, said plunger including a plunger valve opening as said plunger is moved downward through said underground water and closing as said plunger is moved upward through said underground water;

a foot valve controlling a flow of water from a lower portion of said rising main below said plunger, said foot valve opening as water flows into said lower portion, said foot valve closing to prevent a flow of water from said lower portion;

a pressure-tight chamber at a top of said rising main, a pumpstand housing extending upward from said pressure-tight chamber, said pumpstand housing having a drive shaft rotatably mounted therein, said drive shaft having a flywheel and counterweight mounted thereon, said pumpstand housing having a foot pedal rotatably mounted thereon, with a chain drive extending between said foot pedal and said drive shaft to cause rotation of said drive shaft as said foot pedal is rotated;

transmission means for converting rotation of said drive shaft into vertical oscillation of said vertically oscillating structure;

sealing means for preventing loss of water around a portion of said vertically oscillating structure extending through said pressure-tight chamber a discharge pipe extending from said pressure-tight chamber to a storage tank;

a distribution pipe extending from said storage tank to said distribution points; and pressurizing means for inducing a flow of water through said distribution pipe to said distribution points.

10. The water supply system of claim 9, wherein said pressurizing means comprises a closed system holding water, extending downward through a significant distance between a level of water in said storage tank and a level of said distribution pipe.

11. The water supply system of claim 9, wherein said pressurizing means comprises said storage tank formed as a pressure-tight vessel.

12. The water supply system of claim 11 wherein said storage tank includes an elastic bladder.

13. The water supply system of claim 11 wherein air entrapped in said pressure tight vessel is pressurized by the pumping of water into said storage tank.

14. The water supply system of claim 9, wherein said counterweight is clamped at a variable radial distance from said drive shaft.

15. The water supply system of claim 9, wherein said transmission means includes an eccentric pin turning with said drive shaft, and a connecting rod extending between said eccentric pin and said vertically oscillating structure, said connecting rod being rotatably mounted on said eccentric pin and pivotally mounted on said vertically oscillating structure.

16. The water supply system of claim 15, wherein said counterweight is mounted to turn with said drive shaft diametrically opposite said eccentric pin.

17. The water supply system of claim 16, wherein said is clamped within a slot extending radially in said flywheel.

18. The water supply system of claim 9, further comprising a seat attached adjacent said foot pedal.

19. The water supply system of claim 9 further comprising a water treatment system downstream from said discharge pipe.

20. The water supply system of claim 9 further comprising:

an electric motor affixed to said flywheel for maintaining the rotation of said flywheel and a solar panel for providing electric energy to said electric motor.

* * * * *